US012760479B2

(12) United States Patent
Asplin

(10) Patent No.: US 12,760,479 B2
(45) Date of Patent: Oct. 13, 2026

(54) SLAB LIFTING AND LEVELING SYSTEM AND METHOD

(71) Applicant: Charles L. Asplin, Fargo, ND (US)

(72) Inventor: Charles L. Asplin, Fargo, ND (US)

( * ) Notice: Subject to any disclaimer, the term of this patent is extended or adjusted under 35 U.S.C. 154(b) by 559 days.

(21) Appl. No.: 18/447,694

(22) Filed: Aug. 10, 2023

(65) Prior Publication Data

US 2024/0060251 A1 Feb. 22, 2024

Related U.S. Application Data

(60) Provisional application No. 63/371,682, filed on Aug. 17, 2022.

(51) Int. Cl.
*E01C 23/10* (2006.01)
*E04B 1/35* (2006.01)

(52) U.S. Cl.
CPC ..... *E01C 23/10* (2013.01); *E04B 1/3522* (2013.01)

(58) Field of Classification Search
CPC ..... E01C 23/10; E04B 1/3522
See application file for complete search history.

(56) References Cited

U.S. PATENT DOCUMENTS 1,915,032 A * 6/1933 Poulter ..... E01C 23/10 405/266
4,567,708 A * 2/1986 Haekkinen ..... E02D 35/00 404/78
5,795,108 A * 8/1998 Lightle ..... B65G 53/12 406/48
5,860,763 A 1/1999 Asplin
5,979,879 A * 11/1999 Asplin ..... B66F 3/36 254/133 R
6,976,804 B1 * 12/2005 Asplin ..... E01C 23/10 404/78
7,226,274 B1 6/2007 Asplin
7,461,997 B1 * 12/2008 Mack, II ..... E01C 23/10 404/101
8,092,116 B1 1/2012 Asplin
8,186,907 B1 * 5/2012 Asplin ..... E01C 23/10 404/78
8,864,421 B2 10/2014 Asplin
9,422,735 B1 8/2016 Asplin
9,822,497 B2 * 11/2017 Doan ..... E01C 11/005
(Continued)

FOREIGN PATENT DOCUMENTS

CA 2 920 290 10/2016
CA 3 008 108 12/2018
WO 2012/021371 2/2012

*Primary Examiner* — Abigail A Risic
(74) *Attorney, Agent, or Firm* — HSML P.C.

(57) ABSTRACT

Systems and methods for raising a slab, such as a concrete slab, that has sunken and needs to be raised. In one injection, dried sand is carried in a stream of pressurized air and injected underneath the slab. The pressurized air raises the slab, and the dried sand is dispersed over a broad area and great distance underneath the slab to fill voids underneath the slab. Water is then injected underneath the slab for a predetermined period of time to wet the injected dried sand which stabilizes the injected sand and seals the injected sand to minimize or prevent air from passing through the injected sand. After the water injection, additional dried sand and pressurized air is injected underneath the slab to continue the slab lifting and filling of the void(s) underneath the slab.

12 Claims, 4 Drawing Sheets

(56) References Cited

U.S. PATENT DOCUMENTS

| | | | | |
|---|---|---|---|---|
| 10,487,473 | B2 | 11/2019 | Asplin | |
| 10,760,236 | B2 * | 9/2020 | Eddie | G01N 33/24 |
| 11,072,895 | B2 * | 7/2021 | Matsudo | E01C 11/005 |
| 2018/0363266 | A1 | 12/2018 | Asplin | |

* cited by examiner

SLAB LIFTING AND LEVELING SYSTEM AND METHOD

FIELD

This technical disclosure relates to systems and methods of raising an existing slab, such as a concrete slab, which has settled, and leveling the slab.

BACKGROUND

Over time, portions of roadways, driveways, garage floors, sidewalks, patios, etc., often have a tendency to settle or sink. There are several conventional ways to repair sunken slabs. One of these ways is to remove the damaged slab and then re-form the slab. Another method that is often used is referred to as mud jacking. In this repair method a hole is drilled through the sunken slab and wet mud is pumped under the slab until the slab is returned to its original position. Another method that is used is referred to as sand jacking where dried sand and pressurized air are injected under the slab to raise and level the slab. The following patents describe examples of raising objects that have settled: U.S. Pat. Nos. 5,860,763; 5,979,879; 6,976,804; 7,226,274; 8,186,907; 8,092,116; 8,864,421; 9,422,735; U.S. 2018/0363266; and U.S. Pat. No. 10,487,473; each of which is incorporated herein by reference in its entirety.

SUMMARY

Systems and methods for raising a slab that has sunken and needs to be raised are described. In one embodiment, the slab is a concrete slab. However, the slab can be any slab that has sunk and needs to be lifted and leveled.

To lift and level the slab, dried sand is carried in a stream of pressurized air and injected underneath the slab. The pressurized air raises the slab, and the dried sand is dispersed over a broad area and great distance underneath the slab to fill voids underneath the slab. Water is then injected underneath the slab for a predetermined period of time to wet the injected dried sand which stabilizes the injected sand and seals the injected sand to minimize or prevent air from passing through the injected sand. Pressurized air may be injected along with the water. After the water injection, additional dried sand and pressurized air is injected underneath the slab to continue the slab lifting and filling of the void(s) underneath the slab.

The injections described herein may occur through one or more holes drilled through the slab. Alternatively, the injections can occur from one or more sides of the slab.

DRAWINGS

DETAILED DESCRIPTION

Figure 1:
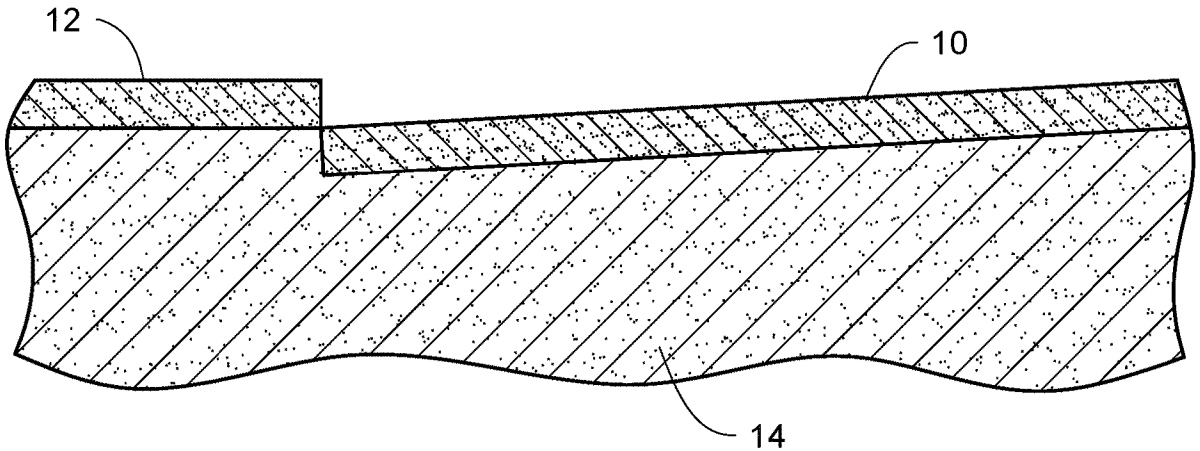
FIG. 1 illustrates a slab that has settled and needs to be lifted and leveled.

FIG. 1 illustrates a slab 10 that has sunken and needs to be raised and leveled so as to be level with an adjacent slab

12. In one embodiment, the slabs 10, 12 are concrete slabs. However, the slabs 10, 12 can be asphalt or other materials. The slabs 10, 12 can form a portion of a roadway, a driveway, a garage floor, a sidewalk, a patio, or the like. The slab 10 may have sunk due to settling or washing away of soil 14 underneath the slab 10.

As described in further detail below, the slab 10 is raised and leveled by conducting a plurality of injections of material underneath the slab 10 to lift the slab 10 and fill a void(s) underneath the slab 10. The injections can occur through one or more holes 16 (see FIG. 2) drilled through the slab 10 as indicated by the arrow A, the injections can occur from one or more sides/ends of the slab 10 as indicated by the arrow B, or the injections can occur via any other location such as through one or more holes in the slab 12 or from one or more sides/ends of the slab 12.

Figure 3:
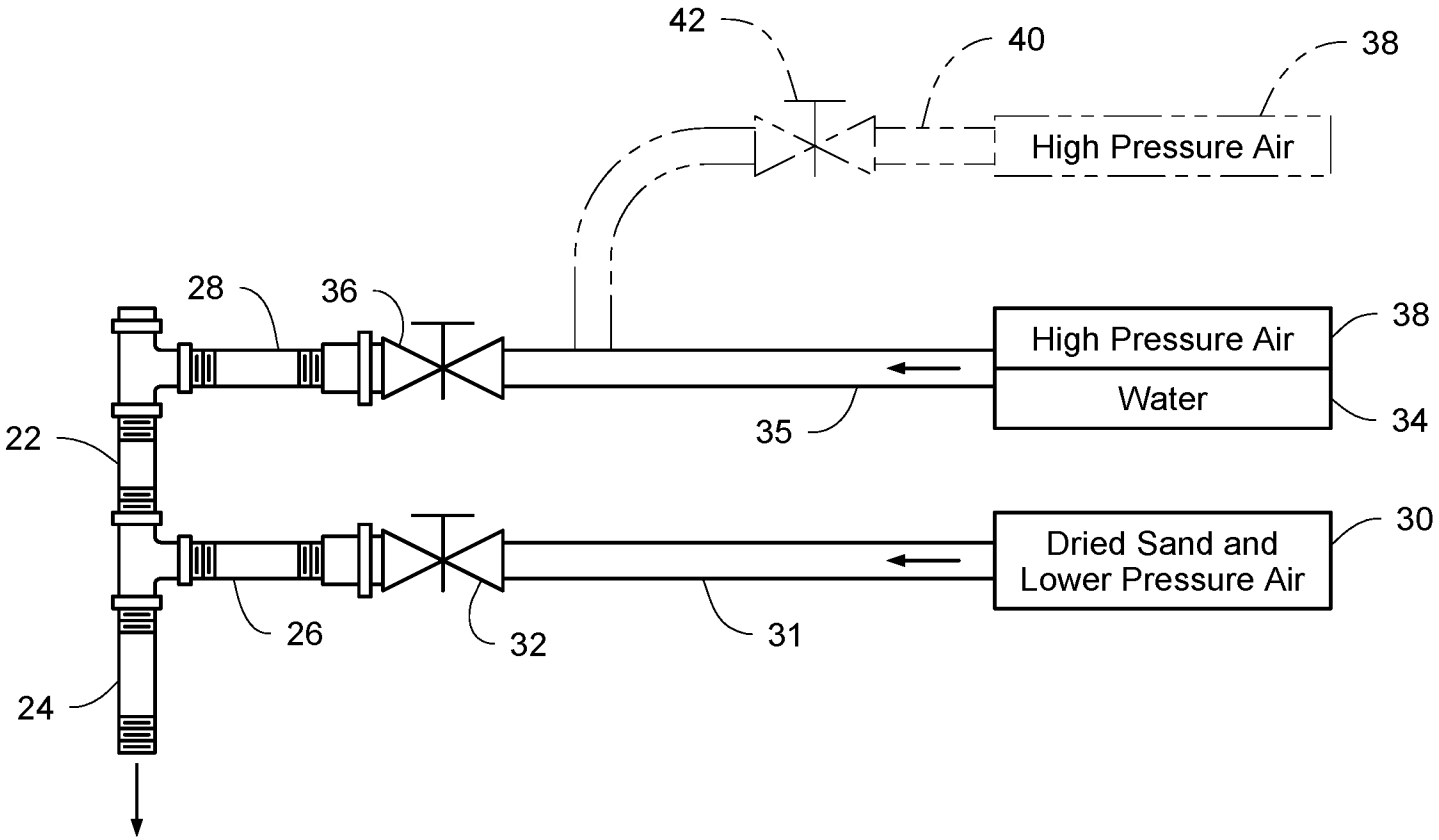
FIG. 3 illustrates an example of a slab lifting and leveling system described herein.

FIG. 3 illustrates an example of a system 20 that can be used to lift and level the slab 10 of FIG. 1. In this example, the system 20 includes an injection manifold 22 having an injection outlet port 24, a first inlet port 26, and a second inlet port 28. The injection outlet port 24 is fluidly connected to the first inlet port 26 and to the second inlet port 28. The injection manifold 22 can be formed of a material, such as steel, that can withstand the injection pressures described herein.

Figure 4:
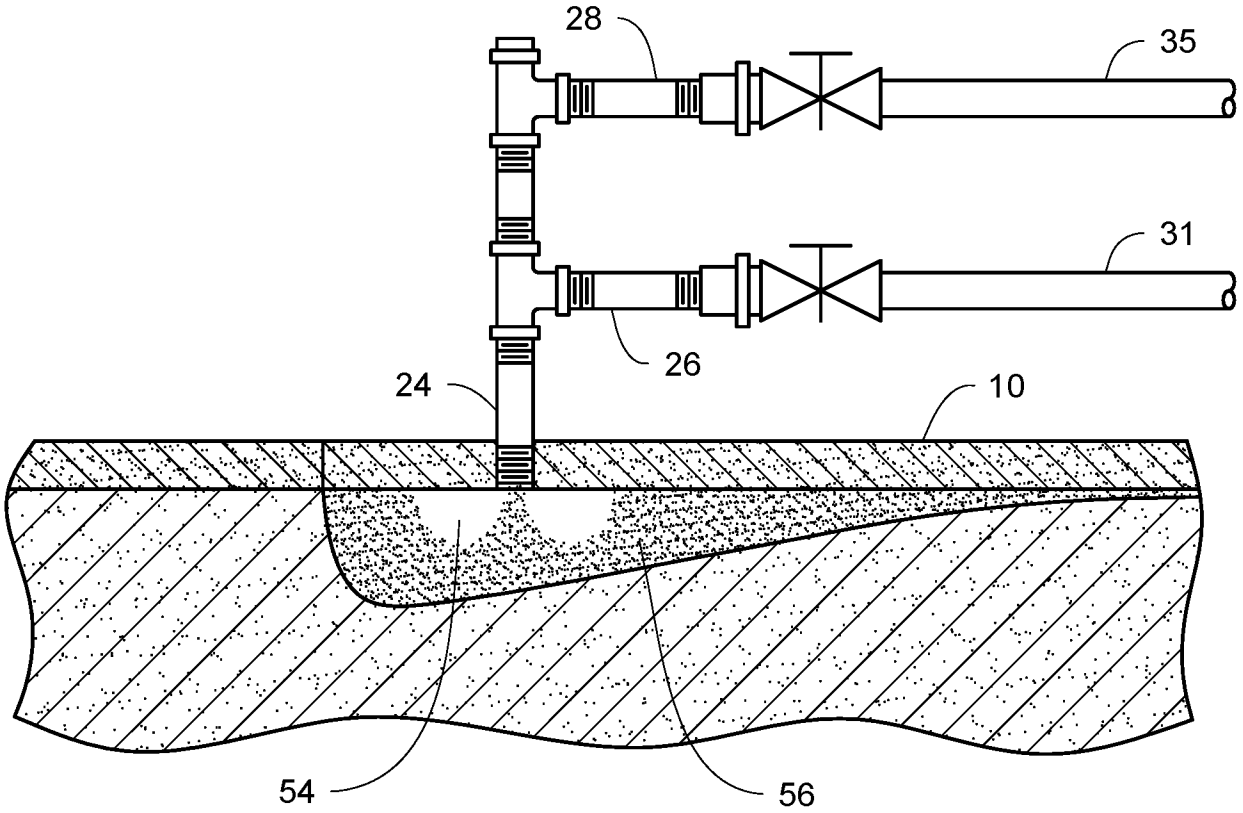
FIG. 4 illustrates the system in place for injections underneath the slab.

The injection outlet port 24 is configured to be fixedly secured within the hole 16 as depicted in FIG. 4. For example, the port 24 can have a diameter that is approximately equal to the diameter of the hole 16, and the end of the port 24 can have exterior threads to help fixedly secure the port 24 in the hole 16.

Returning to FIG. 3, the first inlet port 26 is fluidly connected to a source 30 of dried sand and pressurized air that supplies dried sand and pressurized air to the first inlet port 26 for injection underneath the slab 10 via the port 24. The fluid connection between the inlet port 26 and the source 30 can be achieved by a flexible or rigid hose, a pipe, or other conduit 31. A valve 32, which can be a manually controlled valve or other type of valve, is located in the conduit 31 to be able to control the flow of the dried sand and the pressurized air from the source 30 to the inlet port 26. The source 30 can have any construction that provides dried sand carried by pressurized air. U.S. Pat. No. 8,186,907, which is incorporated herein by reference in its entirety, describes one technique for providing dried sand and pressurized air for injection underneath a slab.

With continued reference to FIG. 3, a source 34 of water is fluidly connected to the second inlet port 28 and that supplies water to the second inlet port 28 for injection underneath the slab 10, for example via the port 24. The fluid connection between the inlet port 28 and the source 34 can be achieved by a flexible or rigid hose, a pipe, or other conduit 35. A valve 36, which can be a manually controlled valve or other type of valve, is located in the conduit 35 to be able to control the flow of the water from the source 34 to the inlet port 28. The source 34 can be a water tank or other device that holds water.

In an embodiment, the water from the source 34 can be injected underneath the slab along with pressurized air. Referring to FIG. 3, the pressurized air can be provided from a pressurized air source 38. In an embodiment, the pressurized air source 38 can be integrated with the water source 34. For example, the sources 34, 38 can be formed by a sealed tank with water residing at a lower portion of the tank and pressurized air provided from the region in the tank above the water level, with the water and pressurized air being mixed together and supplied together via the conduit 35. In another embodiment, the pressurized air source 38 can be separate from the water source 34, and the air source 38 can be fluidly connected to the inlet port 28 via a fluid connection, such as a flexible or rigid hose, a pipe, or other conduit 40, that intersects with the conduit 35. A valve 42, which can be a manually controlled valve or other type of valve, is located in the conduit 40 to control the flow of pressurized air from the source 38.

Figure 2:
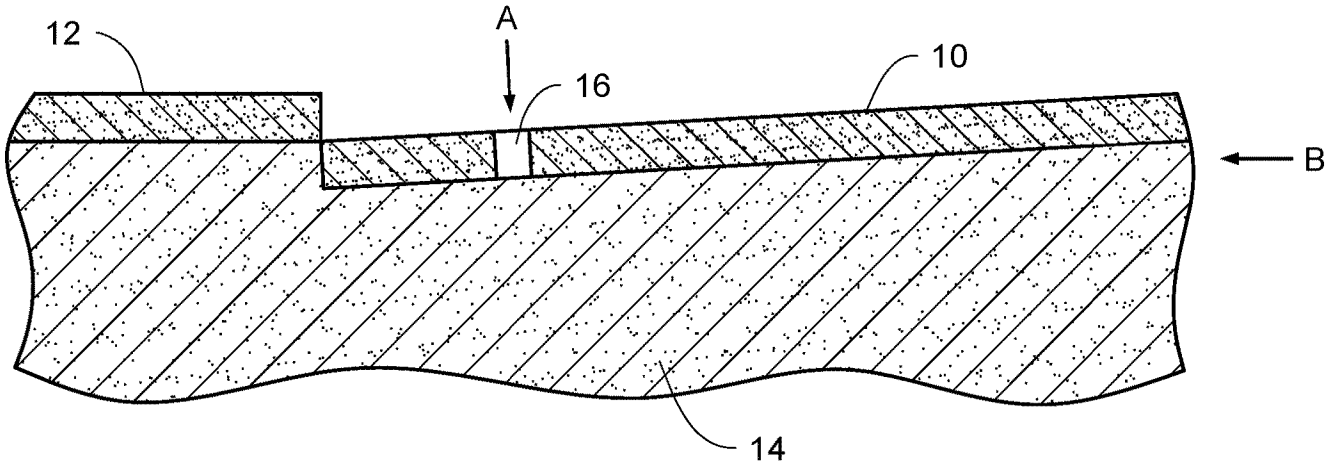
FIG. 2 illustrates a drilled hole formed in the slab through which injections can take place.

For sake of convenience, Applicant will describe the operation of the system 20 as performing all injections through the hole 16 in the slab 10 (FIG. 2). However, as indicated above, the injections of the dried sand and the pressurized air can occur through one hole in the slab 10, while the injection of the water and the optional pressurized air can occur through a different hole in the slab 10. Alternatively, the injections can occur from the sides/ends of the slab 10, through one or more holes in the slab 12, or from the sides/ends of the slab 12.

Figure 5:
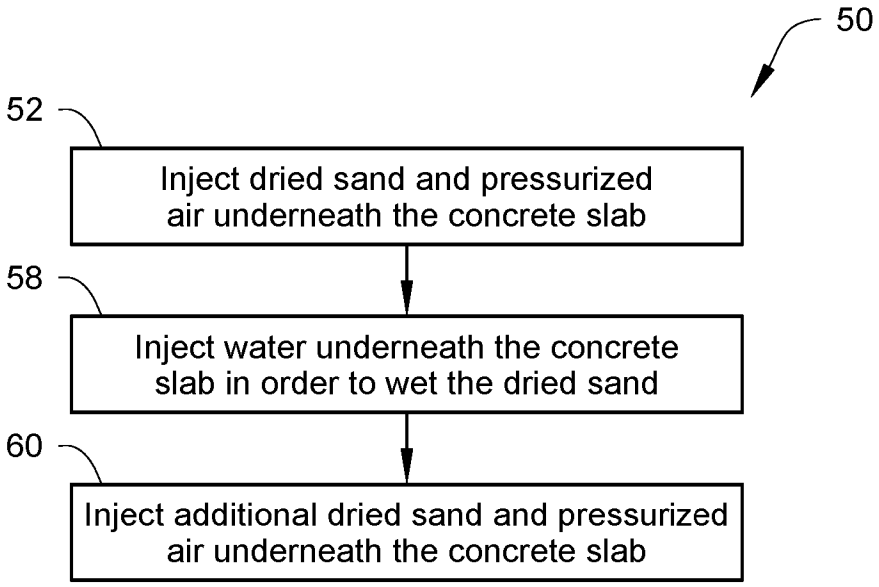
FIG. 5 illustrates a slab lifting and leveling method described herein.

Referring to FIGS. 3-5, the port 24 is inserted into and secured within the hole 16 in the slab 10 as indicated in FIG. 4. FIG. 5 depicts an example of a method 50 of lifting and leveling the slab 10. With the valve 36 closed, in a first injection step 52, dried sand and pressurized air is injected underneath the concrete slab 10. As depicted in FIG. 4, this injection lifts the slab 10 and at least partially fills the void(s) 54 underneath the slab 10 with the dried sand 56. This injection continues for a period of time and ultimately the flow of the dried sand and the pressurized air is then stopped by closing the valve 32, and a water injection 58 then takes place by opening the valve 36. The injection of the water wets the dried sand 56 that has been injected underneath the slab 10 and may even lift the slab 10. The injection of the water occurs for a predetermined period of time sufficient to wet the dried sand. In one embodiment, the predetermined period of time may be 2-6 seconds which is significantly less time than the injection of the dried sand and the pressurized air. At the end of the predetermined period of time, the water injection is stopped by closing the valve 36, and an additional injection 60 is performed by opening the valve 32 and injecting additional dried sand and pressurized air underneath the slab 10. The additional injection 60 may be sufficient to completely lift and level the slab 10. However, one or more additional injections of water to wet the injected wet sand followed by additional injections of dried sand and pressurized air can take place until the slab 10 is sufficiently lifted and leveled.

The pressure of the pressurized air used during each injection of the dried sand can have a first pressure, for example 40 pounds per square inch (psi)±10 psi. In an embodiment, the water may be injected along with pressurized air from the source 38. The pressure of the pressurized air used during the water injection can be at a second pressure, for example 120 psi±10 psi.

Figure 6:
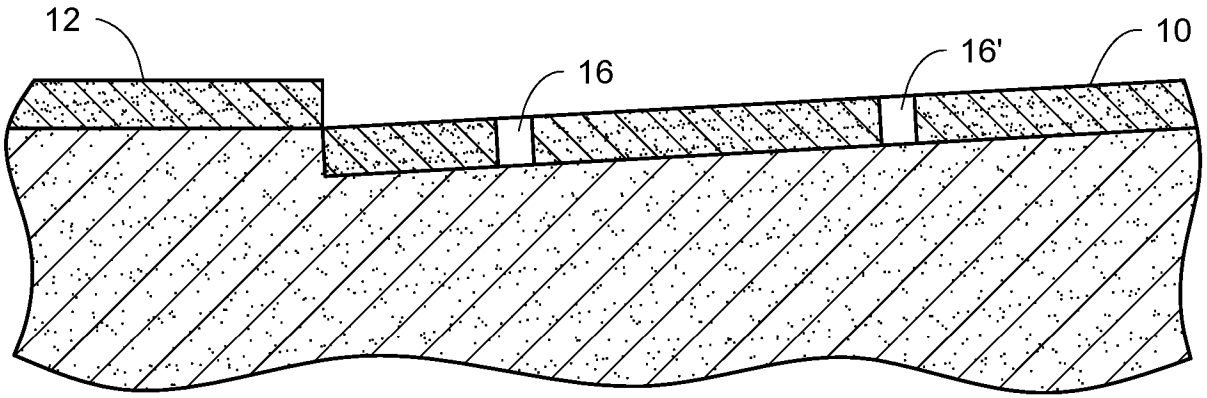
FIG. 6 depicts another embodiment described herein.

With reference to FIG. 6, in another embodiment a second hole 16' can be drilled into the slab 10, and the injection of the water to wet the previously injected dried sand (that is injected through the hole 16) can take place through the second hole 16', for example via the same or different injection manifold used to inject the dried sand. In addition, the injection of the water to wet the dried sand can take place after the initial injection of the dried sand and pressurized air is stopped, or the injection of the water can start after elapse of a period of time after the injection of the dried sand and pressurized air starts and while the injection of the dried sand and the pressurized air continues.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A slab lifting and leveling method, comprising:

in a first injection, injecting dried sand and pressurized air at a first pressure underneath the slab;

after the first injection, performing a second injection that includes injecting water along with air at a second pressure greater than the first pressure underneath the slab for a predetermined period of time; and at the end of the predetermined period of time, stopping the water injection and performing a third injection that includes injecting additional dried sand and pressurized air at the first pressure underneath the slab.

2. The slab lifting and leveling method of claim 1, wherein the predetermined period of time is 2-6 seconds.

3. The slab lifting and leveling method of claim 1, comprising drilling a hole in the slab; and performing the first injection, the second injection, and the third injection via the hole.

4. The slab lifting and leveling method of claim 1, comprising drilling a first hole and a second hole in the slab; and performing the first injection and the third injection via the first hole, and performing the second injection via the second hole.

5. The slab lifting and leveling method of claim 1, wherein the slab is a concrete slab.

6. A concrete slab lifting and leveling method, comprising:

in a first injection, injecting dried sand and pressurized air at a first pressure underneath the concrete slab;

wetting the dried sand that has been injected underneath the concrete slab in the first injection by injecting water along with air at a second pressure greater than the first pressure underneath the concrete slab for a predetermined period of time; and at the end of the predetermined period of time, stopping the water injection and performing a second injection that includes injecting additional dried sand and pressurized air at the first pressure underneath the concrete slab.

7. The concrete slab lifting and leveling method of claim 6, wherein the predetermined period of time is 2-6 seconds.

8. The concrete slab lifting and leveling method of claim 6, comprising drilling a hole in the concrete slab; and performing the first injection, the water injection, and the second injection via the hole.

9. The concrete slab lifting and leveling method of claim 6, comprising drilling a first hole and a second hole in the concrete slab; and performing the first injection and the second injection via the first hole, and performing the water injection via the second hole.

10. A slab lifting and leveling system, comprising:

an injection manifold having an injection outlet port, a first inlet port and a second inlet port, the injection outlet port is fluidly connected to the first inlet port and to the second inlet port;

a source of dried sand and pressurized air fluidly connected to the first inlet port that supplies dried sand and pressurized air to the first inlet port;

a first valve that is located to control the flow of the dried sand and the pressurized air from the source of dried sand and pressurized air to the first inlet port;

a source of water fluidly connected to the second inlet port that supplies water to the second inlet port;

a second valve that is located to control the flow of the water from the source of water to the second inlet port; and a source of pressurized air fluidly connected to the second inlet port that supplies pressurized air to the second inlet port.

11. The slab lifting and leveling system of claim 10, wherein the pressurized air supplied to the first inlet port has a first pressure, and pressurized air supplied to the second inlet port has a second pressure, and the second pressure is greater than the first pressure.

12. The slab lifting and leveling system of claim 10, further comprising a third valve that is positioned to control the flow of the pressurized air from the source of pressurized air to the second inlet port.

* * * * *